US011626074B2

(12) United States Patent
Roh et al.

(10) Patent No.: US 11,626,074 B2
(45) Date of Patent: Apr. 11, 2023

(54) DISPLAY DEVICE

(71) Applicant: SAMSUNG DISPLAY CO., LTD., Yongin-si (KR)

(72) Inventors: Jin Young Roh, Yongin-Si (KR); Hui Nam, Yongin-Si (KR); Se Hyuk Park, Yongin-Si (KR); Hyo Jin Lee, Yongin-Si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 183 days.

(21) Appl. No.: 17/283,430

(22) PCT Filed: Aug. 26, 2019

(86) PCT No.: PCT/KR2019/010848

§ 371 (c)(1),
(2) Date: Apr. 7, 2021

(87) PCT Pub. No.: WO2020/075969

PCT Pub. Date: Apr. 16, 2020

(65) Prior Publication Data

US 2022/0270552 A1 Aug. 25, 2022

(30) Foreign Application Priority Data

Oct. 8, 2018 (KR) ..... 10-2018-0119952

(51) Int. Cl.
*G09G 3/3233* (2016.01)
*G09G 3/3266* (2016.01)

(52) U.S. Cl.
CPC ..... *G09G 3/3266* (2013.01); *G09G 3/3233* (2013.01); *G09G 2320/0247* (2013.01); *G09G 2330/021* (2013.01)

(58) Field of Classification Search
CPC .. G09G 3/3233; G09G 3/3241; G09G 3/3266; G09G 2300/0417;
(Continued)

(56) References Cited

U.S. PATENT DOCUMENTS 9,823,729 B2 11/2017 An et al.
9,953,569 B2 4/2018 Mu et al.
(Continued)

FOREIGN PATENT DOCUMENTS

KR 1020150057190 A * 11/2013 ..... G09G 3/3233
KR 10-2016-0052942 5/2016
(Continued)

OTHER PUBLICATIONS

International Search Report issued in corresponding application No. PCT/KR2019/010848 dated Dec. 9, 2019.

*Primary Examiner* — Michael J Eurice
(74) *Attorney, Agent, or Firm* — F. Chau & Associates, LLC

(57) ABSTRACT

A display device includes a display panel including a plurality of pixels each coupled to a write scan line, a compensation scan line, an initialization scan line, a bypass scan line, and a data line; and a scan driver configured to supply i (where i is a natural number) write scan pulses, compensation scan pulses, initialization scan pulses, and bypass scan pulses to the write scan line, the compensation scan line, the initialization scan line, and the bypass scan line, respectively, during a first period corresponding to one frame period, and to supply j (where j is a natural number other than i) write scan pulses to the write scan line during each of frame periods of a second period including a plurality of consecutive frame periods.

20 Claims, 10 Drawing Sheets

(58) Field of Classification Search
CPC ... G09G 2300/0819; G09G 2300/0842; G09G 2300/0847; G09G 2300/0861; G09G 2310/0216; G09G 2310/0251; G09G 2310/0264; G09G 2310/061; G09G 2310/08; G09G 2320/0233; G09G 2320/0247; G09G 2320/043; G09G 2320/045; G09G 2230/00; G09G 2330/021; G09G 2330/022; G09G 2340/0435
See application file for complete search history.

(56) References Cited

U.S. PATENT DOCUMENTS

| | | | | |
|---|---|---|---|---|
| 9,966,007 | B2 | 5/2018 | Cho et al. | |
| 10,381,426 | B2 | 8/2019 | Ka et al. | |
| 10,783,832 | B2 | 9/2020 | Shin et al. | |
| 10,964,264 | B1 * | 3/2021 | Kim | G09G 3/3233 |
| 2006/0267889 | A1 | 11/2006 | Kimura | |
| 2015/0294618 | A1 * | 10/2015 | Park | G09G 3/3291 345/78 |
| 2016/0104423 | A1 * | 4/2016 | Park | G09G 3/3233 345/78 |
| 2016/0217739 | A1 * | 7/2016 | Kang | G09G 3/3233 |
| 2016/0351122 | A1 | 12/2016 | Jung et al. | |
| 2016/0365035 | A1 * | 12/2016 | Park | G09G 3/3266 |
| 2018/0125716 | A1 | 5/2018 | Cho et al. | |
| 2018/0158414 | A1 | 6/2018 | Lee | |
| 2018/0174514 | A1 | 6/2018 | Lee | |
| 2019/0164491 | A1 * | 5/2019 | Kim | G09G 3/3233 |

FOREIGN PATENT DOCUMENTS

| | | |
|---|---|---|
| KR | 10-2017-0003849 | 1/2017 |
| KR | 10-1788432 | 10/2017 |
| KR | 10-2018-0004369 | 1/2018 |
| KR | 10-2018-0011397 | 2/2018 |
| KR | 10-2018-0052501 | 5/2018 |
| KR | 10-2018-0063405 | 6/2018 |
| KR | 10-2018-0071572 | 6/2018 |
| KR | 10-2018-0081196 | 7/2018 |
| KR | 1020150057190 A * | 2/2020 |

* cited by examiner

Low power driving mode

DISPLAY DEVICE

CROSS-REFERENCE TO RELATED APPLICATIONS

This application is a National Stage of International Application No. PCT/KR2019/010848 filed on Aug. 26, 2019, which claims priority to Korean Patent Application No. 10-2018-0119952 filed on Oct. 8, 2018 in the Korean Patent Office, the disclosures which are incorporated by reference herein in their entireties.

TECHNICAL FIELD

Various embodiments of the present disclosure relate to a display device, and more particularly to a display device to which a scan signal including a plurality of scan pulses is applied.

BACKGROUND ART

Among display devices, an organic light-emitting display device displays an image using an organic light-emitting diode which generates light through recombination of electrons and holes, and is advantageous in that it is driven with low power consumption while having a high response speed.

A driving transistor included in each pixel has hysteresis characteristics in which a threshold voltage is shifted and a current (or, a driving current) is changed depending on a change in a gate voltage. Due to the hysteresis characteristics of the driving transistor, a current different from a set current flows through the pixel depending on the previous data voltage of the corresponding pixel. Accordingly, the pixel may not generate light with desired luminance in a current frame.

Hysteresis characteristics are enhanced with a driving scheme for supplying scan signals, each including a plurality of scan pulses, in accordance with respective pixel rows that may be applied.

DISCLOSURE

Technical Problem

Various embodiments of the present disclosure are directed to a display device which varies the number of scan pulses during low power driving.

However, the objects of the present disclosure are not limited to the foregoing objects, and may be expanded in various forms without departing from the spirit and scope of the present disclosure.

Technical Solution

A display device according to embodiments of the present disclosure to accomplish one object of the present disclosure may include a display panel including a plurality of pixels each coupled to a write scan line, a compensation scan line, an initialization scan line, a bypass scan line, and a data line; and a scan driver configured to supply i (where i is a natural number) write scan pulses, compensation scan pulses, initialization scan pulses, and bypass scan pulses to the write scan line, the compensation scan line, the initialization scan line, and the bypass scan line, respectively, during a first period corresponding to one frame period, and to supply j (where j is a natural number other than i) write scan pulses to the write scan line during each of frame periods of a second period including a plurality of consecutive frame periods.

In accordance with an embodiment, a number of the write scan pulses supplied during the first period may be less than a number of the write scan pulses supplied during each of the frame periods of the second period.

In accordance with an embodiment, during the first period, one of the write scan pulses and one of the compensation scan pulses may be supplied after one of the initialization scan pulses have been supplied.

In accordance with an embodiment, the write scan pulses and the compensation scan pulses may be simultaneously supplied.

In accordance with an embodiment, the i initialization scan pulses and the i write scan pulses may be alternately supplied.

In accordance with an embodiment, a width of each of the write scan pulses, the compensation scan pulses, the initialization scan pulses, and the bypass scan pulses corresponding to the first period may be less than a width of each of the write scan pulses corresponding to the second period.

In accordance with an embodiment, the display device may further include an emission driver configured to supply an emission control signal to an emission control line coupled to each of the pixels, and defining an emission period and a non-emission period of each of the frame periods.

In accordance with an embodiment, during the non-emission period of the first period, in which the emission control signal is not supplied, the write scan pulses, the compensation scan pulses, the initialization scan pulses, and the bypass scan pulses may be supplied, and during the non-emission period of the second period, the write scan pulses may be supplied.

In accordance with an embodiment, a width of the emission control signal supplied during the first period may be greater than a width of the emission control signal supplied during each of the frame periods of the second period.

In accordance with an embodiment, each of the pixels may include an organic light-emitting diode; a first transistor coupled between a first node, electrically coupled to a first power source, and a second node, electrically coupled to an anode electrode of the organic light-emitting diode, and configured to control a driving current; a second transistor coupled between the data line and the first node and turned on in response to the write scan pulses; a third transistor coupled between the second node and a third node coupled to a gate electrode of the first transistor and turned on in response to the compensation scan pulses; a fourth transistor coupled between the third node and an initialization power source and turned on in response to the initialization scan pulses; a fifth transistor coupled between the first power source and the first node and turned on in response to an emission control signal; a sixth transistor coupled between the second node and the anode electrode of the organic light-emitting diode and turned on in response to the emission control signal; a seventh transistor coupled between the initialization power source and the anode electrode of the organic light-emitting diode and configured to receive the bypass scan pulses; and a storage capacitor coupled between the first power source and the third node.

In accordance with an embodiment, the first, second, fifth, sixth and seventh transistors may be P-type LTPS thin film transistors, and the third and fourth transistors may be N-type oxide semiconductor thin film transistors.

In accordance with an embodiment, a gate-on voltage of the emission control signal, the write scan pulses, and the bypass scan pulses may be at a logic low level, and the compensation scan pulses and the initialization scan pulses may be at a logic high level.

In accordance with an embodiment, the bypass scan pulses may be identical to the write scan pulses.

In accordance with an embodiment, the first, second, fifth, and sixth transistors may be P-type LTPS thin film transistors, and the third, fourth, and seventh transistors may be N-type oxide semiconductor thin film transistors.

In accordance with an embodiment, the bypass scan pulses may be identical to the compensation scan pulses.

In accordance with an embodiment, the bypass scan pulses may be identical to the initialization scan pulses.

In accordance with an embodiment, the display device may further include a data driver configured to supply a data signal corresponding to a grayscale of an image to the data line in the first period.

In accordance with an embodiment, the data driver may supply a preset reference voltage to the data line during the second period.

In accordance with an embodiment, i may be 1, and j may be 3.

In accordance with an embodiment, the second period may include 59 frame periods.

Advantageous Effects

The display device according to embodiments of the present disclosure varies the number of write scan pulses so that the number of write scan pulses to be supplied during a data write period of a first period is less than the number of write scan pulses to be supplied during each bias period of a second period in a low power driving mode, thus decreasing the difference between on-bias values of a first transistor (driving transistor) during the first period and the second period. Therefore, flicker that can be perceived when driving at low frequencies less than or equal to 20 Hz (e.g., at 1 Hz) may be alleviated. Accordingly, both power consumption and display quality in a low power driving mode may be enhanced.

However, the advantages of the present disclosure are not limited to the foregoing advantages, and may be expanded in various forms without departing from the spirit and scope of the present disclosure.

MODE FOR INVENTION

Figure 1:
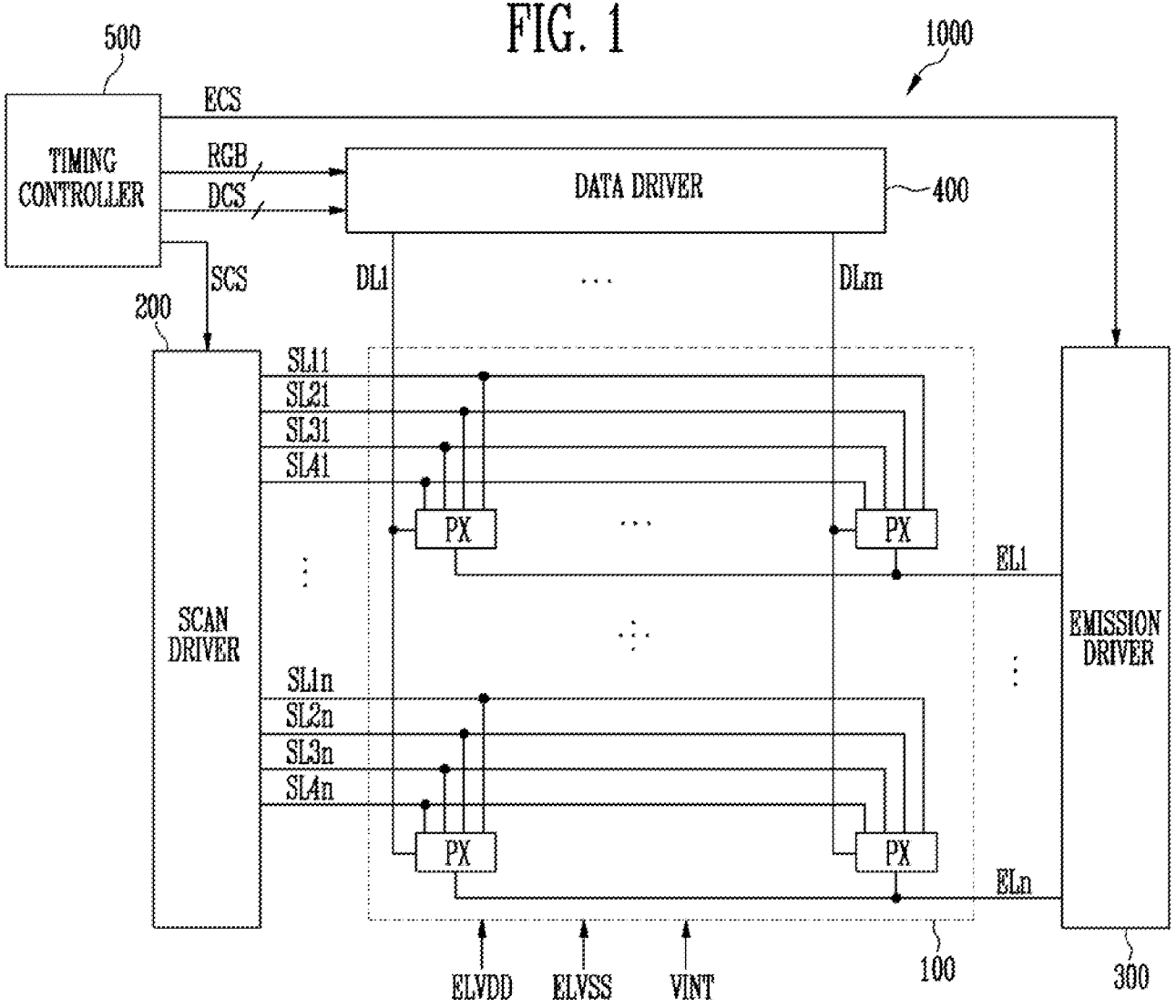
FIG. 1 is a block diagram illustrating a display device according to an embodiment of the present disclosure.

Embodiments of the present disclosure will hereinafter be described in detail with reference to the accompanying drawings. The same reference numerals are used to designate the same or similar components throughout the drawings, and repeated descriptions thereof will be omitted.

FIG. 1 is a block diagram illustrating a display device according to an embodiment of the present disclosure. Referring to FIG. 1, a display device 1000 may include a display panel 100, a scan driver 200, an emission driver 300, a data driver 400, and a timing controller 500.

In an embodiment, the display device 1000 may further include a power supply which supplies a first power source voltage ELVDD, a second power source voltage ELVSS, and a third power source voltage VINT to the display panel 100. However, this is only an example, and at least one of the first power source voltage ELVDD, the second power source voltage ELVSS, and the third power source voltage VINT may also be supplied from the timing controller 500 or the data driver 400.

In an embodiment, the display device 1000 may be operated such that the driving modes thereof are separated into a normal driving mode and a low power driving mode. The normal driving mode may be a driving mode in which the display panel 100 normally displays input image data. For example, in the normal mode, a normal image or a video may be displayed in response to a user's command input or the like.

In contrast, the low power driving mode may be a mode in which, when the display device 1000 is in a standby state, simple always-on display information is constantly displayed (e.g., an always-on display [AOD] mode).

The display panel 100 may include a plurality of write scan lines SL11 to SL1*n*, a plurality of compensation scan lines SL21 to SL2*n*, a plurality of initialization scan lines SL31 to SL3*n*, a plurality of bypass scan lines SL41 to SL4*n*, a plurality of emission control lines EL1 to ELn, and a plurality of data lines DL1 to DLm, and may include a plurality of pixels PX respectively coupled to the write scan lines SL11 to SL1*n*, the compensation scan lines SL21 to SL2*n*, the initialization scan lines SL31 to SL3*n*, the bypass scan lines SL41 to SL4*n*, the emission control lines EL1 to ELn, and the data lines DL1 to DLm (where n and m are integers greater than 1). Each of the pixels PX may include a driving transistor and a plurality of switching transistors.

However, the write scan lines SL11 to SL1*n*, the compensation scan lines SL21 to SL2*n*, the initialization scan lines SL31 to SL3*n*, and the bypass scan lines SL41 to SL4*n* are only expressions used to distinguish scan lines coupled to different components in each pixel PX for convenience of description, and are not intended to limit the functions of respective scan lines and scan signals.

The scan driver 200 may sequentially supply scan signals to the pixels PX through the write scan lines SL11 to SL1*n*, the compensation scan lines SL21 to SL2*n*, the initialization scan lines SL31 to SL3*n*, and the bypass scan lines SL41 to SL4*n* based on a first control signal SCS. The scan driver 200 receives the first control signal SCS, at least one clock signal, etc. from the timing controller 500.

In an embodiment, a scan signal that is supplied through one scan line during one frame period may include one or more scan pulses. For example, scan signals may include a write scan signal sequentially supplied to the write scan lines SL11 to SL1*n*, a compensation scan signal sequentially supplied to the compensation scan lines SL21 to SL2*n*, an initialization scan signal sequentially supplied to the initialization scan lines SL31 to SL3*n*, and a bypass scan signal sequentially supplied to the bypass scan lines SL41 to SL4*n*.

However, the write scan signal, the compensation scan signal, the initialization scan signal, and the bypass scan signal are only expressions used to distinguish scan signals that are respectively supplied to scan lines coupled to different components in each pixel PX for convenience of description, and are not intended to limit the functions of the scan signals.

The write scan signal may include at least one write scan pulse, the compensation scan signal may include at least one compensation scan pulse, the initialization scan signal may include at least one initialization scan pulse, and the bypass scan signal may include at least one bypass scan pulse.

Here, each of the write scan pulse, the compensation scan pulse, the initialization scan pulse, and the bypass scan pulse may be a gate-on voltage for turning on the corresponding transistor included in each of the pixels PX. For example, when the transistor included in each of the pixels PX is a P-channel metal oxide semiconductor (PMOS) transistor, the gate-on voltage may be set to a logic low level. When the transistor included in each of the pixels PX is an N-channel metal oxide semiconductor (NMOS) transistor, the gate-on voltage may be set to a logic high level.

In an embodiment, the scan driver 200 may include first stages dependently coupled to each other so as to sequentially output the write scan signal (write scan pulses) to the write scan lines SL11 to SL1*n*, second stages dependently coupled to each other so as to sequentially output the compensation scan signal (compensation scan pulses) to the compensation scan lines SL21 to SL2*n*, third stages dependently coupled to each other so as to sequentially output the initialization scan signal (initialization scan pulses) to the initialization scan lines SL31 to SL3*n*, and fourth stages dependently coupled to each other so as to sequentially output the bypass scan signal (bypass scan pulses) to the bypass scan lines SL41 to SL4*n*. However, since this is only an example, some of the first to fourth stages may be omitted when predetermined scan signals have the same waveform or are output in a shifted form. For example, the compensation scan signal and the initialization scan signal may be output from the same stages (e.g., second stages), and the third stages may be omitted.

The emission driver 300 may sequentially supply an emission control signal to the pixels PX through the emission control lines EL1 to ELn based on a second control signal ECS. The emission driver 300 receives the second control signal ECS, the clock signal, etc. from the timing controller 500. The emission control signal may divide one frame period into an emission period and a non-emission period, with respect to pixel lines.

The data driver 400 may receive a third control signal DCS and image data signals RGB from the timing controller 500. The data driver 400 may supply a data signal (data voltage) to the pixels PX through the data lines DL1 to DLm based on the third control signal DCS and the image data signals RGB. In an embodiment, the data driver 400 may supply either a data signal corresponding to the grayscale of an image or a preset reference voltage to the data lines DL1 to DLm depending on the driving mode of the display device 1000.

For example, a data signal for a corresponding pixel PX may be supplied to the corresponding pixel PX in synchronization with each write scan signal (write scan pulses).

The timing controller 500 may control the driving of the scan driver 200, the emission driver 300, and the data driver 400 based on externally supplied timing signals. The timing controller 500 may provide control signals including the first control signal SCS, a scan clock signal, etc. to the scan driver 200, and may provide control signals including the second control signal ECS, an emission control clock signal, etc. to the emission driver 300. The third control signal DCS for controlling the data driver 400 may include a source start signal, a source output enable signal, a source sampling clock, etc.

Figure 2:
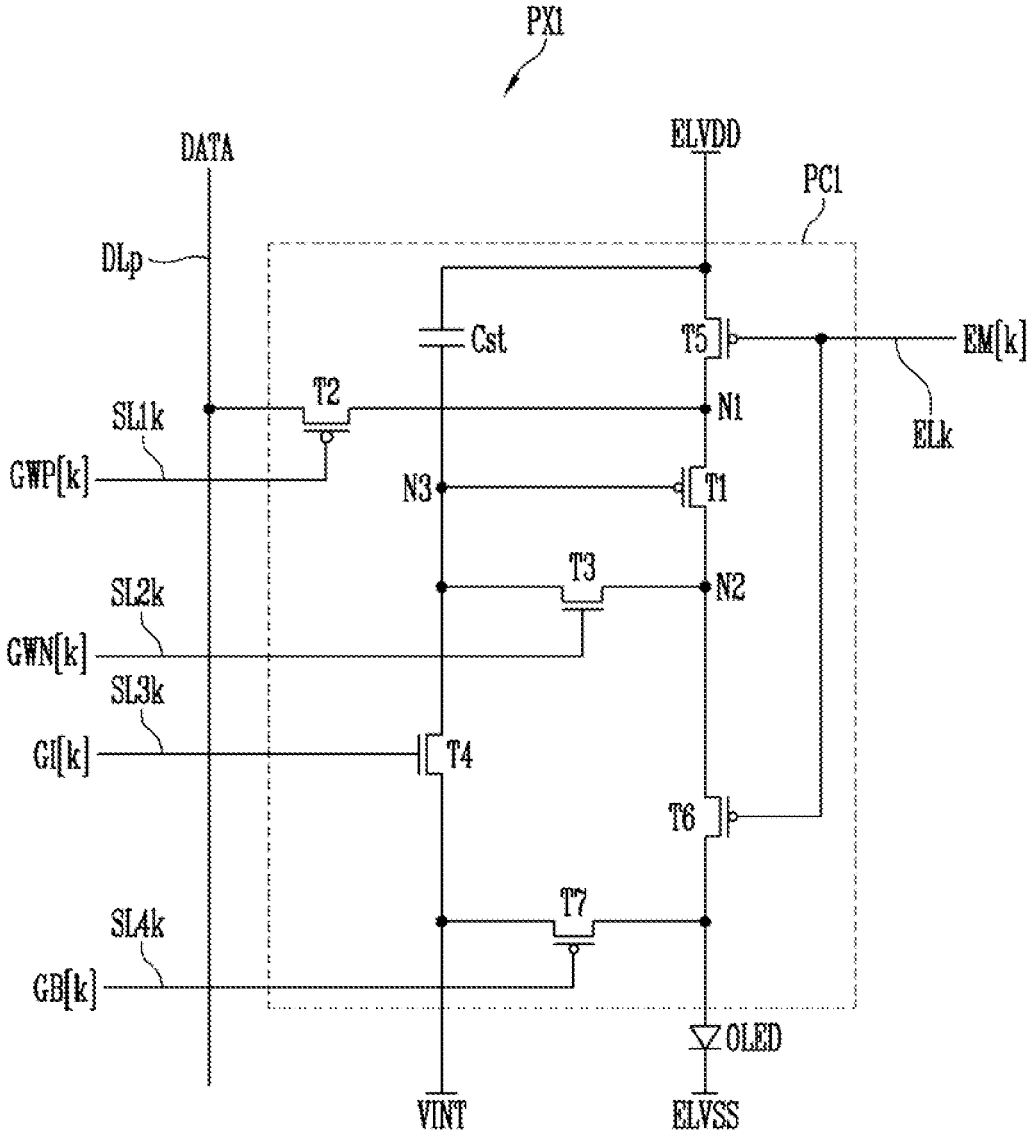
FIG. 2 is a circuit diagram illustrating an example of a pixel included in the display device of FIG. 1.

FIG. 2 is a circuit diagram illustrating an example of a pixel included in the display device of FIG. 1.

Referring to FIGS. 1 and 2, a pixel PX1 may include an organic light-emitting diode OLED and a pixel circuit PC1 coupled to the organic light-emitting diode OLED.

The pixel PX1 of FIG. 2 is a pixel arranged in a k-th row and a p-th column (where k and p are natural numbers).

An anode electrode of the organic light-emitting diode OLED may be coupled to the pixel circuit PC1, and a cathode electrode thereof may be coupled to a second power source ELVSS. The organic light-emitting diode OLED may generate light with a predetermined luminance in accordance with the amount of current supplied from the pixel circuit PC1.

The pixel circuit PC1 controls the amount of current that flows from the first power source ELVDD to the second power source ELVSS via the organic light-emitting diode OLED in response to a data voltage DATA. For this, the pixel circuit PC1 may include first to seventh transistors T1 to T7 and a storage capacitor Cst.

The first transistor T1 may be coupled between a first node N1, electrically coupled to the first power source ELVDD, and a second node N2, electrically coupled to the anode electrode of the organic light-emitting diode OLED. The first transistor T1 may generate a driving current and provide the driving current to the organic light-emitting diode OLED. A gate electrode of the first transistor T1 may be coupled to a third node N3. The first transistor T1 functions as a driving transistor of the pixel PX1.

The second transistor T2 may be coupled between a p-th data line DLp and the first node N1. The second transistor T2 may include a gate electrode for receiving a write scan signal GWP[k]. When the second transistor T2 is turned on, the data voltage DATA may be transferred to the first node N1.

The third transistor T3 may be coupled between the second node N2 and the third node N3. The third transistor T3 may include a gate electrode for receiving a compensation scan signal GWN[k]. The third transistor T3 is turned on in response to the compensation scan signal GWN[k], thus electrically coupling a second electrode of the first transistor T1 to the third node N3. Therefore, when the third transistor T3 is turned on, the first transistor T1 may be coupled in the form of a diode. That is, the third transistor T3 may function to write the data voltage DATA to the first transistor T1 and compensate for a threshold voltage thereof.

The storage capacitor Cst may be coupled between the first power source ELVDD and the third node N3. The storage capacitor Cst may store a voltage corresponding to the data voltage DATA and the threshold voltage of the first transistor T1.

The fourth transistor T4 may be coupled between the third node N3 and the third power source VINT. The fourth transistor T4 may include a gate electrode for receiving an initialization scan signal GI[k]. In an embodiment, the initialization scan signal GI[k] may correspond to a compensation scan signal GWN[k] corresponding to a previous pixel row. The fourth transistor T4 may be turned on when the initialization scan signal GI[k] is supplied, thus supplying the voltage of the third power source VINT to the third node N3. Accordingly, the voltage of the third node N3, that is, the gate voltage of the first transistor T1, may be initialized to the voltage of the third power source VINT. In an embodiment, the third power source VINT may be set to a voltage lower than the minimum voltage of the data voltage.

The fifth transistor T5 may be coupled between the first power source ELVDD and the first node N1. The fifth transistor T5 may include a gate electrode for receiving an emission control signal EM[k].

The sixth transistor T6 may be coupled between the second node N2 and the anode electrode of the organic light-emitting diode OLED. The sixth transistor T6 may include a gate electrode for receiving the emission control signal EM[k].

The fifth and sixth transistors T5 and T6 may be turned on during a gate-on period of the emission control signal EM[k], and may be turned off during a gate-off period.

The seventh transistor T7 may be coupled between the third power source VINT and the anode electrode of the organic light-emitting diode OLED. The seventh transistor T7 may include a gate electrode for receiving a bypass scan signal GB[k]. In an embodiment, the bypass scan signal GB[k] may correspond to the write scan signal GWP[k]. However, this is only an example, and the bypass scan signal GB[k] may correspond to a write scan signal GWP[k−1] supplied to a previous pixel row or a write scan signal GWP[k+1] to be supplied to a next pixel row.

When the bypass scan signal GB[k] is supplied, the seventh transistor T7 may be turned on, thus supplying the voltage of the third power source VINT to the anode electrode of the organic light-emitting diode OLED.

In an embodiment, each of the first, second, fifth, sixth, and seventh transistors T1, T2, T5, T6, and T7 may be a P-type Low-Temperature Poly-Silicon (LTPS) thin film transistor, and each of the third and fourth transistors T3 and T4 may be an N-type oxide semiconductor thin film transistor. Since the N-type oxide semiconductor thin film transistor has better current leakage characteristics than the P-type LTPS thin film transistor, the third and fourth transistors T3 and T4, which are switching transistors, may be embodied as N-type oxide semiconductor thin film transistors.

Accordingly, the leakage current of the third and fourth transistors T3 and T4 may be greatly decreased, and pixel driving and image display at low frequencies less than 30 Hz are enabled. That is, power consumption in a low power driving mode may be reduced.

Hereinafter, a scheme for driving the display device including the pixel PX1 of FIG. 2 will be described in detail.

Figure 3:
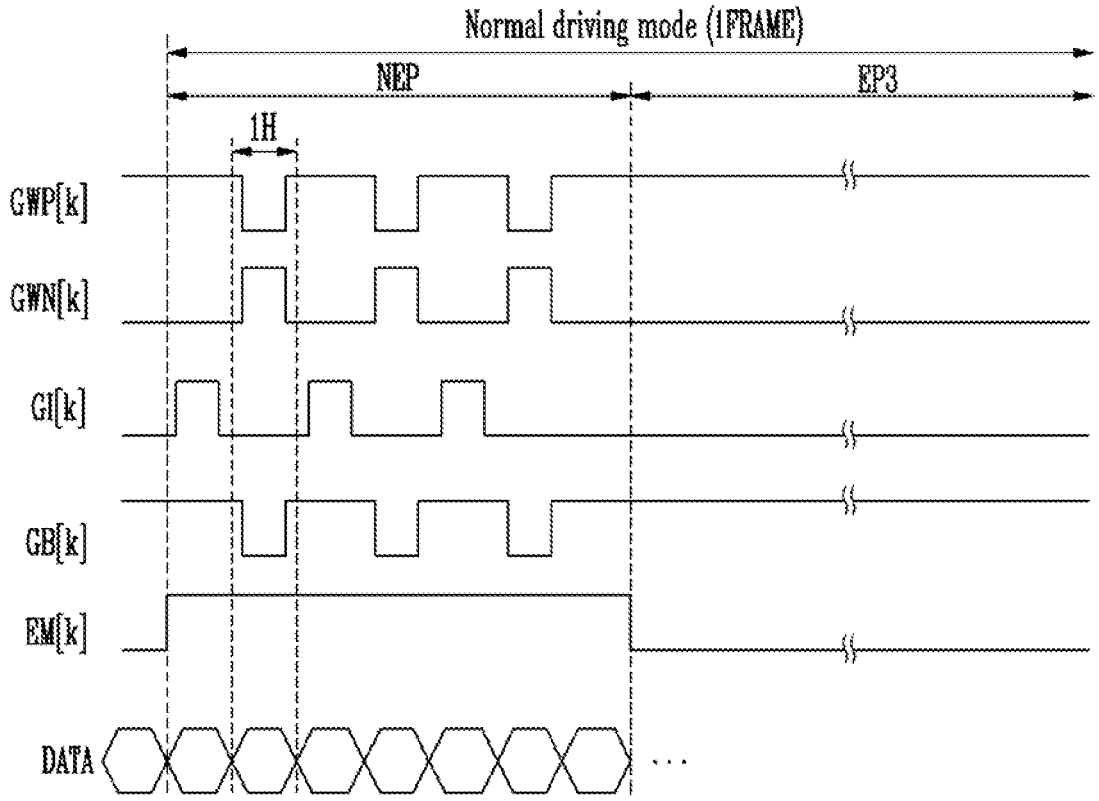
FIG. 3 is a diagram illustrating an example of the driving of the display device of FIG. 1.

FIG. 3 is a diagram illustrating an example of the driving of the display device of FIG. 1.

Referring to FIGS. 1 to 3, the display device 1000 may be operated in a normal driving mode.

FIG. 3 illustrates an example of signals supplied to a pixel PX1 included in a k-th row in the normal driving mode. In the normal driving mode, the scan signals GWP[k], GWN[k], GI[k] and GB[k] and the emission control signal EM[k] may be supplied to the display panel 100 at the same frequency during each frame period. One frame period may include an emission period EP3 and a non-emission period NEP.

In FIG. 3, although it is illustrated that the lengths of the emission period EP3 and the non-emission period NEP included in one frame period are similar to each other, it should be understood that the length of the emission period EP3 is actually greater than that of the non-emission period NEP.

Since the second and seventh transistors T2 and T7 are P-type LTPS transistors, gate-on voltages of the write scan signal GWP[k] (and the write scan pulse) and the bypass scan signal GB[k] (and the bypass scan pulse) may be at a logic low level. Similarly, the gate-on voltage of the emission control signal EM[k] may be at a logic low level.

Since the third and fourth transistors T3 and T4 are N-type oxide semiconductor thin film transistors, gate-on voltages of the compensation scan signal GWN[k] (and the compensation scan pulse) and the initialization scan signal GI[k] (and the initialization scan pulse) may be at a logic high level.

In an embodiment, in the normal driving mode, during the non-emission period NEP, three types of scan pulses (i.e., write scan pulses, compensation scan pulses, initialization scan pulses, and bypass scan pulses) may be supplied to the pixel PX1. For example, the initialization scan pulses and the write scan pulses may be alternately supplied. The compensation scan pulses and the bypass scan pulses may be supplied simultaneously with the write scan pulses.

In an embodiment, the compensation scan signal GWN[k] transferred to a compensation scan line SL2$k$ may be a signal obtained by shifting the initialization scan signal GI[k] transferred to an initialization scan line SL3$k$ by a 1 horizontal period (1H). For example, the initialization scan signal GI[k] transferred to an initialization scan line SL3$k$ may be identical to a compensation scan signal GWN[k−1] transferred to a compensation scan line SL2$k$−1 for a previous pixel line. A pixel line denotes pixels coupled in common to one compensation scan line and one initialization scan line.

In response to the first two respective initialization scan pulses of the initialization scan signal GI[k], the gate voltage of the first transistor T1 may be initialized, and the first transistor T1 may enter an on-bias state. Also, in response to the first two write scan pulses and compensation scan pulses of the write scan signal GWP[k] and the compensation scan signal GWN[k], respectively, the first transistor T1 may enter an off-bias state.

That is, since the gate voltage (and the gate-source voltage) of the first transistor T1 repeatedly varies, a change in hysteresis of the first transistor T1 attributable to the difference between the data voltage in the previous frame and the data voltage in the current frame may be decreased.

Thereafter, the gate voltage of the first transistor T1 may be initialized again in response to a third initialization scan pulse, and a data voltage DATA corresponding to a third write scan pulse may be stored in the storage capacitor Cst in response to the third write scan pulse and a third compensation scan pulse.

Thereafter, during the emission period EP3, the pixel PX1 may emit light with a grayscale corresponding to the data voltage DATA stored in the storage capacitor Cst.

The bypass scan signal GB[k] is irrelevant to the bias state of the first transistor T1. For example, the anode electrode of the organic light-emitting diode OLED may be initialized in response to the bypass scan pulse.

In this way, in the normal driving mode, the on-bias state and the off-bias state of the first transistor T1 are repeated within one frame period, and thus the change in the hysteresis of the first transistor T1 may be decreased, and an instantaneous afterimage, appearing when a change in luminance is large, may be alleviated.

However, because, in an operation in the normal driving mode, each of scan signals includes a plurality of scan pulses, high driving frequency is required and power consumption is increased. Therefore, when the display device 1000 displays a standby image, a low grayscale image, a still image, etc., a scheme for reducing power consumption by lowering the driving frequency is required.

Figure 4:
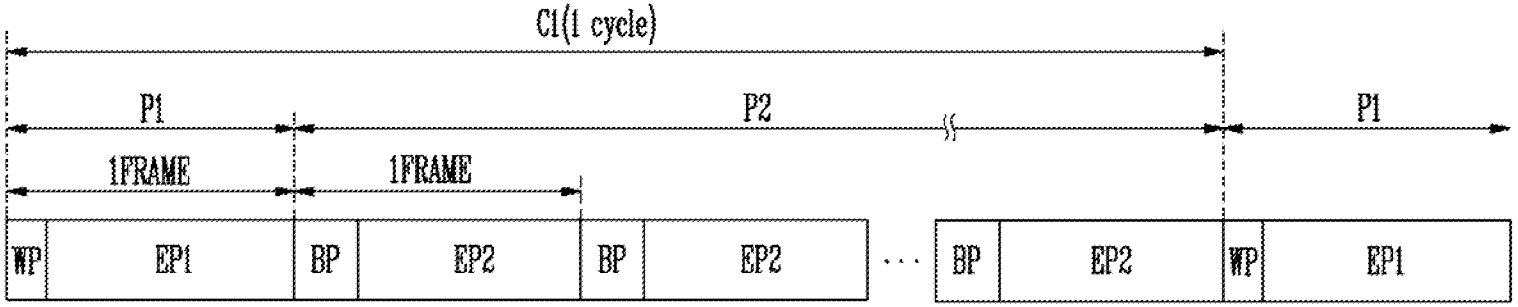
FIG. 4 is a diagram illustrating an example of the driving of the display device of FIG. 1.
Figure 5A:
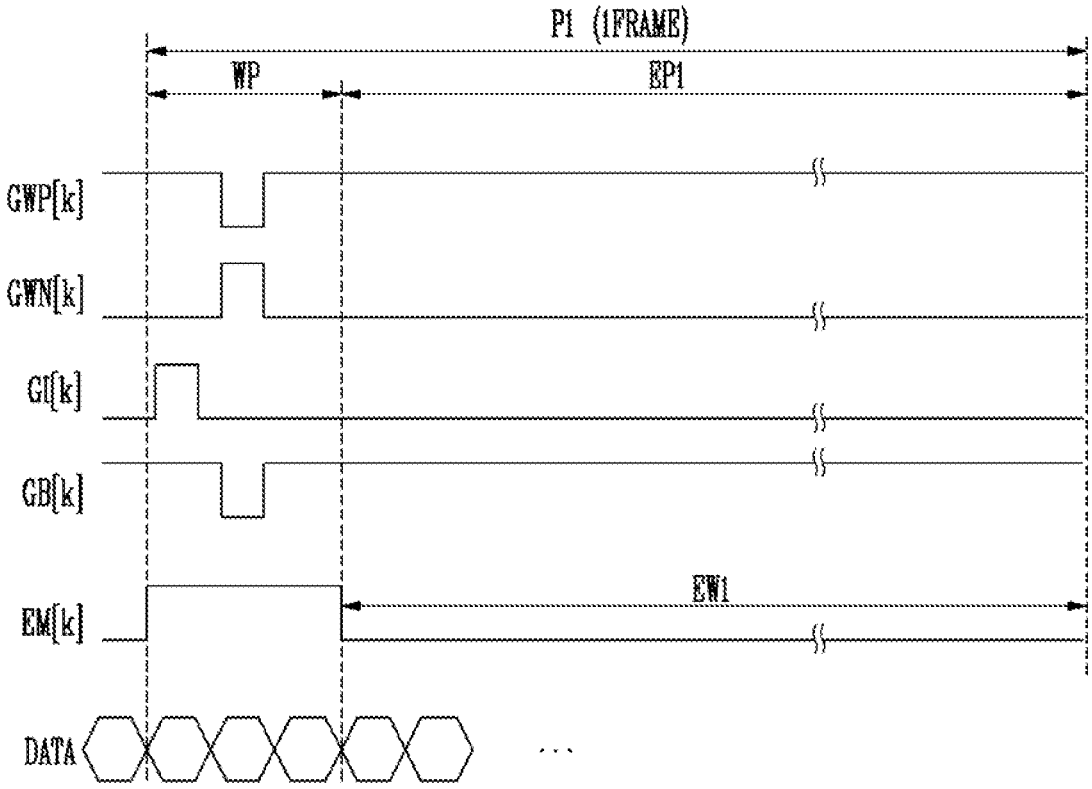
FIG. 5*a* is a waveform diagram illustrating an example of operation of the display device of FIG. 1 during a first period.
Figure 5B:
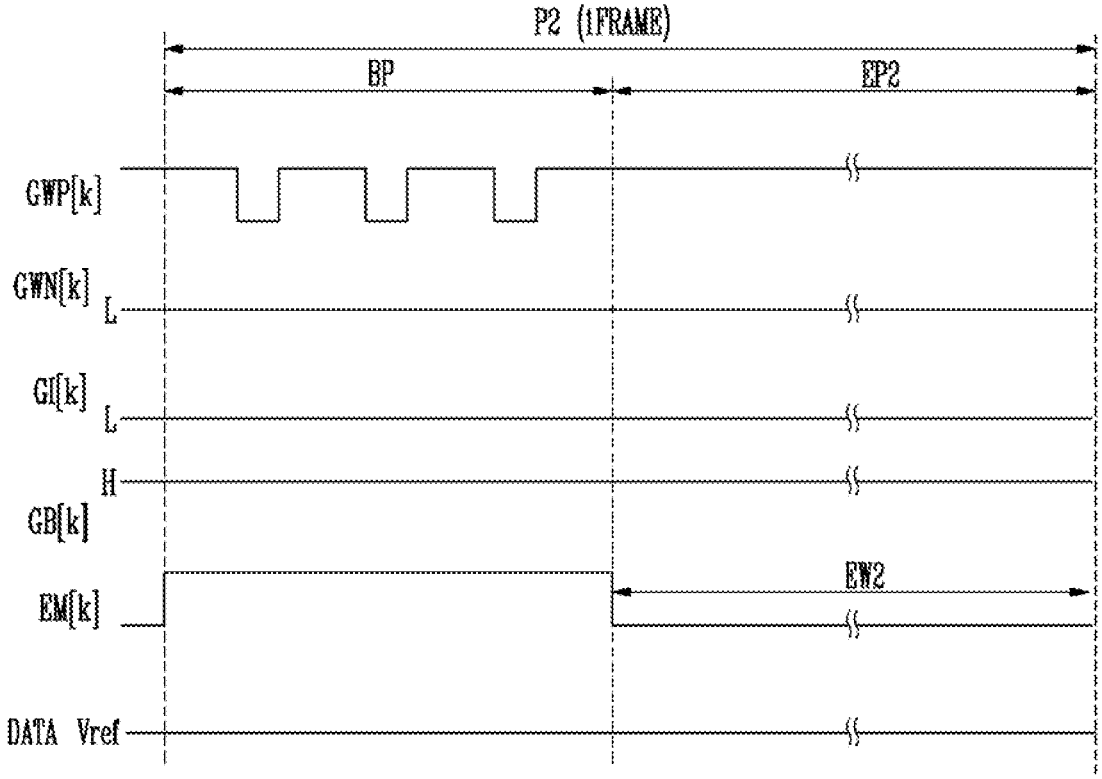
FIG. 5*b* is a waveform diagram illustrating an example of operation of the display device of FIG. 1 during a second period.

FIG. 4 is a diagram illustrating an example of the driving of the display device of FIG. 1, FIG. 5*a* is a waveform diagram illustrating an example of operation of the display device of FIG. 1 during a first period, and FIG. 5*b* is a waveform diagram illustrating an example of operation of the display device of FIG. 1 during a second period.

Referring to FIGS. 1 to 5*b*, the display device 1000 may be operated in a low power driving mode.

FIG. 4 schematically illustrates a form in which a pixel PX1 included in a k-th row is driven in the low power driving mode. As illustrated in FIG. 4, in the low power driving mode, the display device 1000 may be operated in one cycle C1 including a first period P1 corresponding to one frame period and a second period P2 including a plurality of consecutive frame periods.

The first period P1 may include a data write period WP and a first emission period EP1. Each frame period of the second period P2 may include a bias period BP and a second emission period EP2.

The data write period WP denotes a period during which the second and third transistors T2 and T3 are turned on and then a data voltage DATA is stored in the storage capacitor Cst. The bias period BP denotes a period during which only the second transistor T2 is turned on to supply a predetermined voltage to the source electrode of the first transistor T1 and then the on-bias state of the first transistor T1 is held. Accordingly, it may be understood that the first period P1 is a data_write period and the second period P2 is a holding period.

In the low power driving mode, during the first cycle C1, the pixel PX1 may actually emit light with a grayscale corresponding to the data voltage DATA written during the data write period WP. For example, the first cycle C1 may be set to 60 Hz, and may include 60 frame periods. In this case, the second period P2 may have 59 frame periods. That is, the pixel PX1 may emit light during frame periods based on the data voltage DATA written during the data write period WP in one frame period.

In an embodiment, during the second period P2, only the write scan signal GWP[k] is applied to the first transistor T1 so as to apply an on-bias thereto, and the remaining scan signals GWN[k], GI[k], and GB[k] are not supplied thereto. Therefore, power consumption required to supply scan signals does not occur. For example, when the first cycle C1 is set to 60 Hz, the compensation scan signal GWN[k], the initialization scan signal GI[k], and the bypass scan signal GB[k] may be output at 1 Hz in the low power driving mode. Therefore, the driving required to output the compensation scan signal GWN[k], the initialization scan signal GI[k], and the bypass scan signal GB[k] may also be performed at 1 Hz. However, this is only an example, and the compensation scan signal GWN[k], the initialization scan signal GI[k], and the bypass scan signal GB[k] may also be output at low frequencies less than or equal to 20 Hz in the low power driving mode.

Meanwhile, in such a low power driving mode, when the write scan signal GWP[k] is supplied in the same manner as in the normal driving mode, a difference may occur between the on-bias of the first transistor T1 during the first period P1 and the on-bias of the first transistor T1 during the second period P2. Due to the difference in the on-bias, a difference in luminance may occur between the first period P1 and the second period P2. In particular, in the case of low-grayscale emission having a high data voltage DATA, the luminance difference may be perceived as the flicker of an image due to the large on-bias difference.

The display device 1000 according to embodiments of the present disclosure may alleviate flicker by varying the numbers of write scan pulses of write scan signals GWP[k] respectively supplied during the first period P1 and the second period P2 in the low power driving mode. Here, the number of scan pulses included in each of the compensation scan signal GWN[k], the initialization scan signal GI[k], and the bypass scan signal GB[k] that are supplied during the first period P1 is identical to the number of write scan pulses.

Also, the write scan pulses (write scan signal GWP[k]), the compensation scan pulses (compensation scan signal GWN[k]) and the bypass scan pulses (bypass scan signal GB[k]) may be simultaneously supplied during the first period P1.

During the first period P1, i (where i is a natural number) write scan pulses, compensation scan pulses, initialization scan pulses, and bypass scan pulses may be supplied to the write scan line SL1*k*, the compensation scan line SL2*k*, the initialization scan line SL3*k*, and the bypass scan line SL4*k*, respectively, and during each of the frame periods included in the second period P2, j (where j is a natural number other than i) write scan pulses may be supplied to the write scan line SL1*k*.

In an embodiment, the number of write scan pulses supplied during the first period P1 may be less than the number of write scan pulses supplied during each of frame periods of the second period P2. For example, as illustrated in FIGS. 5*a* and 5*b*, during the first period P1, one write scan pulse may be supplied, and during each of the frame periods of the second period P2, three write scan pulses may be supplied.

In an embodiment, during a non-emission period of the first period P1, in which the emission control signal EM[k] is not supplied, a write scan pulse, a compensation scan pulse, an initialization scan pulse, and a bypass scan pulse may be supplied. In an embodiment, during a non-emission period of the second period P2, only write scan pulses may be supplied.

Accordingly, the width EW1 of the emission control signal EM[k] supplied during the first period P1 may be greater than the width EW2 of the emission control signal EM[k] supplied during each of the frame periods of the second period P2. In other words, the first emission period EP1 may be longer than the second emission period EP2.

During the first period P1, after the initialization scan pulse has been supplied, the write scan pulse and the compensation scan pulse may be supplied. When one write scan pulse is supplied during the first period P1, the first transistor T1 may have an on-bias state based on the third power source VINT and the first power source ELVDD in response to the initialization scan pulse (i.e., the initialization scan signal GI[k]). In this case, a repetitive bias state change such as that in the normal driving mode is not applied.

Further, in synchronization with the write scan pulse and the compensation scan pulse, the data voltage DATA may be supplied to the pixel PX1, and may be stored in the storage capacitor Cst. During the first emission period EP1, the pixel PX1 may emit light with a grayscale corresponding to the data voltage DATA stored in the storage capacitor Cst.

The bias period BP included in each of the frame periods of the second period P2 may correspond to a non-emission period of one frame period. As illustrated in FIG. 5*b*, three write scan pulses may be supplied during the bias period BP. For example, during the second period P2, the write scan signal GWP[k] may be supplied in the same manner as in the normal driving mode.

During the bias period BP, the compensation scan signal GWN[k], the initialization scan signal GI[k], and the bypass scan signal GB[k] are not supplied. For example, the compensation scan signal GWN[k] and the initialization scan signal GI[k] may have a logic low level L, and the bypass scan signal GB[k] may have a logic high level H. However, this is only an example, and the bypass scan signal GB[k] may have the same waveform as the write scan signal GWP[k].

In an embodiment, during the second period P2, a reference voltage Vref may be supplied to a data line DLp. The reference voltage Vref may determine the on-bias value of the first transistor T1. For example, when the write scan pulses are supplied, the reference voltage Vref may be supplied to the source electrode (i.e., the first node N1) of the first transistor T1. Therefore, the on-bias voltage of the first transistor T1 may be determined depending on the magnitude of the reference voltage Vref. For example, the reference voltage Vref may be a voltage corresponding to a black grayscale.

Meanwhile, the on-bias value based on the reference voltage Vref may be less than the on-bias value based on the third power source VINT and the first power source ELVDD during the data write period WP. Accordingly, the difference between the on-bias values of the first transistor T1 during the first period P1 and the second period P2 may be reduced by increasing the number of applications of on-bias during the bias period BP from the number of applications of on-bias during the data write period WP.

As illustrated in FIG. 5*b*, on-bias may be applied three times during the bias period BP. Accordingly, the hysteresis characteristics of the first transistor T1 may be continuously changed in an on-bias direction.

As described above, the difference between the on-bias value of the first transistor T1 during the first period P1 and the on-bias value of the first transistor T1 during the second period P2 may be reduced by varying the number of write scan pulses so that, in the low power driving mode, the number of write scan pulses of the write scan signal GWP[k] (and the number of compensation scan pulses) to be supplied during the data write period WP of the first period P1 is less than the number of write scan pulses to be supplied during the bias period BP of the second period P2. Therefore, the difference between the hysteresis characteristics during the first period P1 and the second period P2 may be improved, and flicker, which may be problematic in driving at low frequencies less than or equal to 20 Hz (e.g., at 1 Hz), may be alleviated. Accordingly, both power consumption and display quality in the low power driving mode may be enhanced.

Figure 6A:
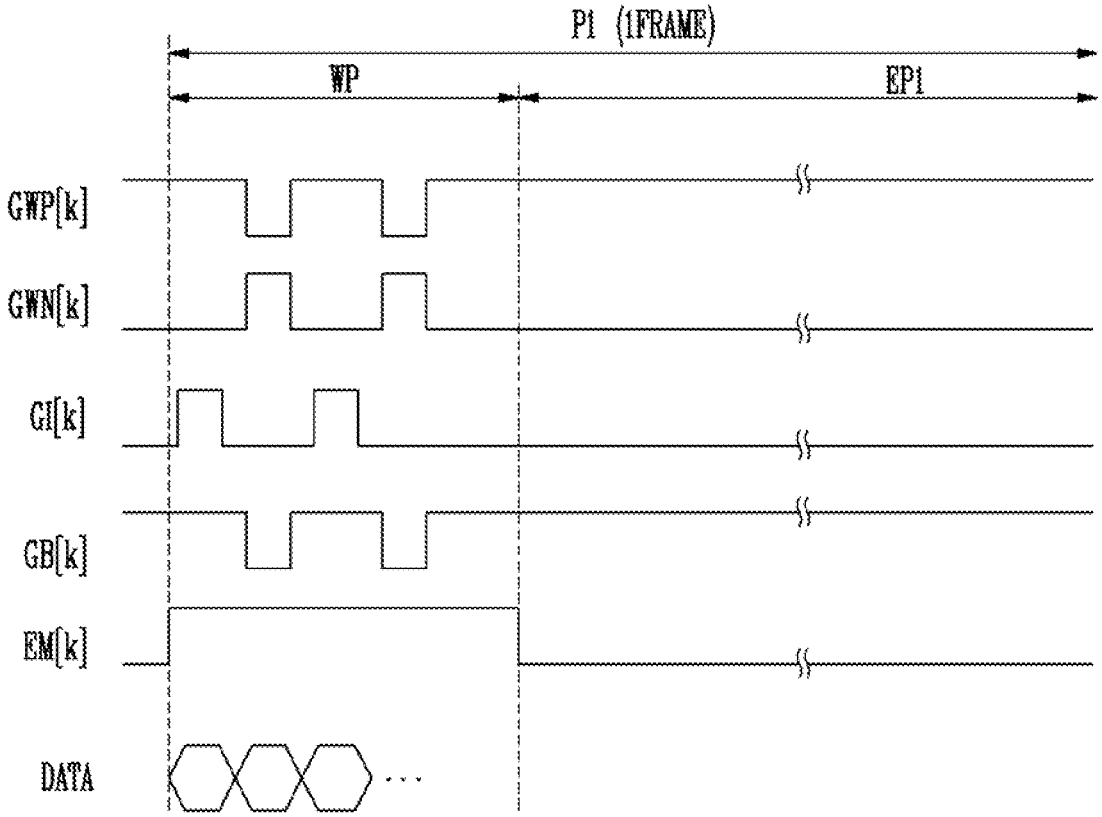
FIG. 6*a* is a waveform diagram illustrating an example of operation of the display device of FIG. 1 during a first period.
Figure 6B:
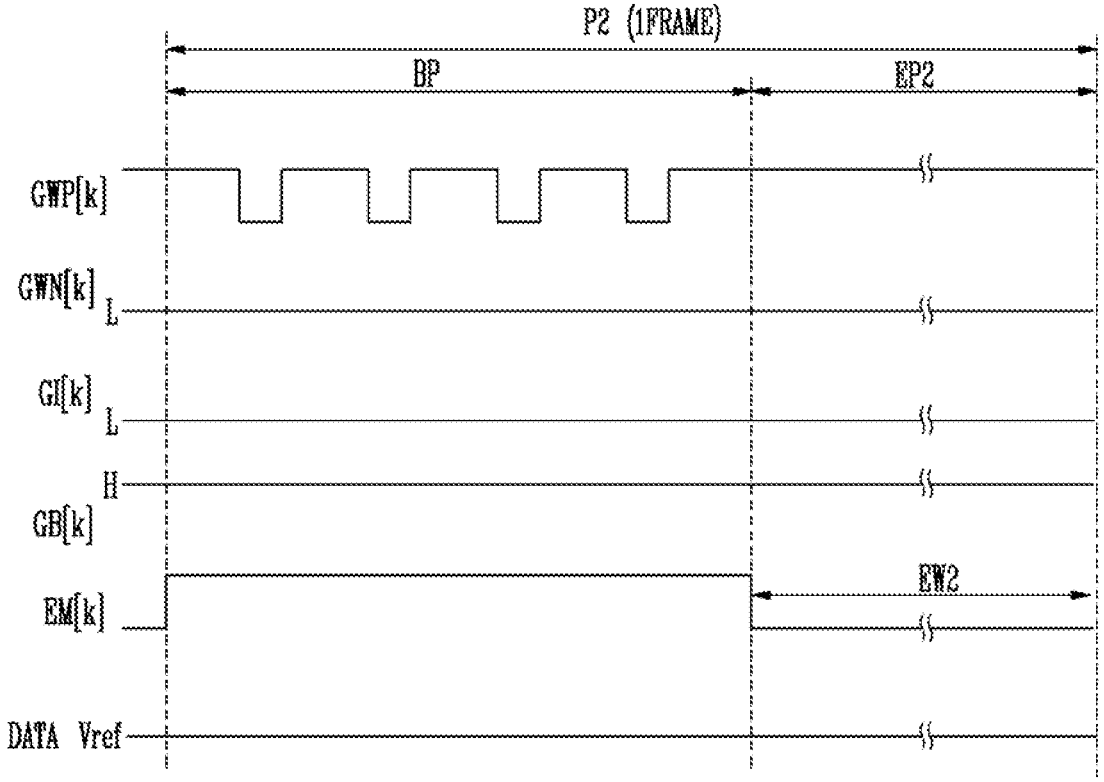
FIG. 6*b* is a waveform diagram illustrating an example of operation of the display device of FIG. 1 during a second period.

FIG. 6*a* is a waveform diagram illustrating an example of operation of the display device of FIG. 1 during a first period, and FIG. 6*b* is a waveform diagram illustrating an example of operation of the display device of FIG. 1 during a second period.

Since the operation of the display device illustrated in FIGS. 6*a* and 6*b* is the same as the operation thereof in the low power driving mode illustrated in FIGS. 5*a* and 5*b*, except for the numbers of scan pulses supplied during a data write period WP and a bias period BP, the same reference numerals are used for the same or corresponding components, and repeated descriptions thereof are omitted.

Referring to FIGS. 5*a* to 6*b*, the display device 1000 may be operated in the low power driving mode. The display device 1000 may alleviate flicker by varying the numbers of write scan pulses of write scan signals GWP[k] to be respectively supplied during the first period P1 and the second period P2 in the low power driving mode.

The number of write scan pulses supplied during the first period P1 may be less than the number of write scan pulses supplied during each of frame periods of the second period P2. For example, the number of write scan pulses supplied during the data write period WP of the first period P1 may be less than the number of write scan pulses supplied during the non-emission period NEP of each frame period in the normal driving mode (see FIG. 3). Furthermore, the number of write scan pulses supplied during the bias period BP of the second period P2 may be greater than the number of write scan pulses supplied during the non-emission period NEP of each frame period in the normal driving mode (see FIG. 3). As illustrated in FIGS. 6*a* and 6*b*, during the data write period WP, two write scan pulses may be supplied, and during the bias period BP, four write scan pulses may be supplied.

Accordingly, the difference between the on-bias values of the first transistor T1 during the first period P1 and the second period P2, in which low frequency driving is performed, may be reduced, and flicker may be alleviated. Accordingly, both power consumption and display quality in the low power driving mode may be enhanced.

Figure 7:
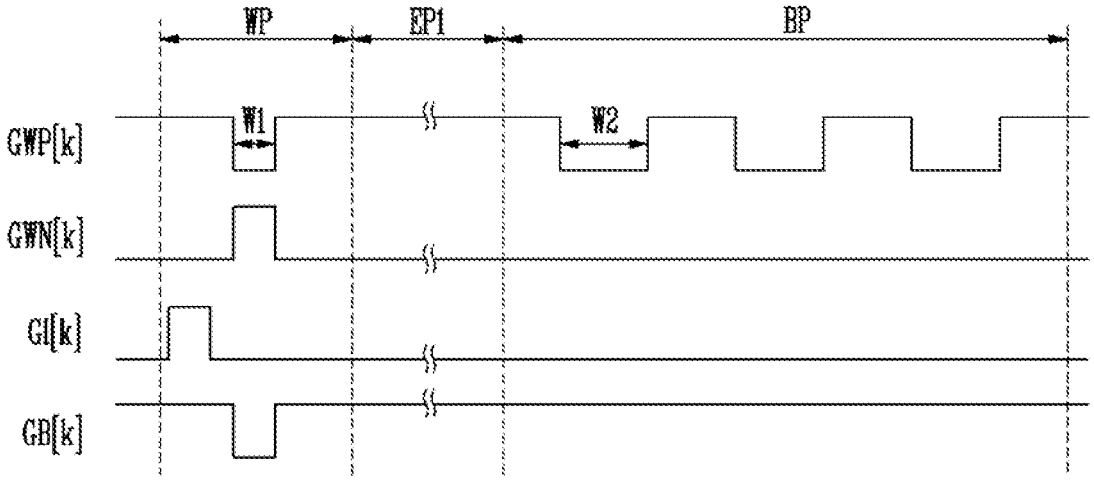
FIG. 7 is a waveform diagram illustrating an example of operation of the display device of FIG. 1 during a first period and a second period.

FIG. 7 is a waveform diagram illustrating an example of operation of the display device of FIG. 1 during a first period and a second period.

Since the operation of the display device illustrated in FIG. 7 is the same as the operation thereof in the low power driving mode illustrated in FIGS. 5*a* and 5*b*, except for the widths of scan pulses supplied during a data write period WP and a bias period BP, the same reference numerals are used for the same or corresponding components, and repeated descriptions thereof are omitted.

Referring to FIGS. 5*a*, 5*b*, and 7, the display device 1000 may be operated in a low power driving mode.

The display device 1000 may alleviate flicker by varying the numbers of write scan pulses of write scan signals GWP[k] to be respectively supplied during the first period P1 and the second period P2 in the low power driving mode. The number of write scan pulses supplied during the first period P1 may be less than the number of write scan pulses supplied during each of frame periods of the second period P2.

In an embodiment, the width W1 of the write scan pulse supplied during the data write period WP of the first period P1, the width W1 of the compensation scan pulse, the width W1 of the initialization scan pulse, and the width W1 of the bypass scan pulse may be less than the width W2 of each of the write scan pulses supplied during the bias period BP of the second period P2. For example, as the width W2 of each of the write scan pulses supplied during the bias period BP is increased, an on-bias value corresponding thereto may be increased.

The on-bias value based on the reference voltage Vref during the bias period BP may be less than the on-bias value based on the third power source VINT and the first power source ELVDD during the data write period WP. Therefore, the number of applications of on-bias during the bias period BP may be increased from the number of applications of on-bias during the data write period WP, and the width W2 of the write scan pulses during the bias period BP may be increased from the width W1 of the write scan pulse during the data write period WP.

The difference between the on-bias values of the first transistor T1 during the first period P1 and the second period P2 may be more precisely controlled, and may be minimized.

Accordingly, flicker in the low power driving mode may be alleviated.

Figure 8:
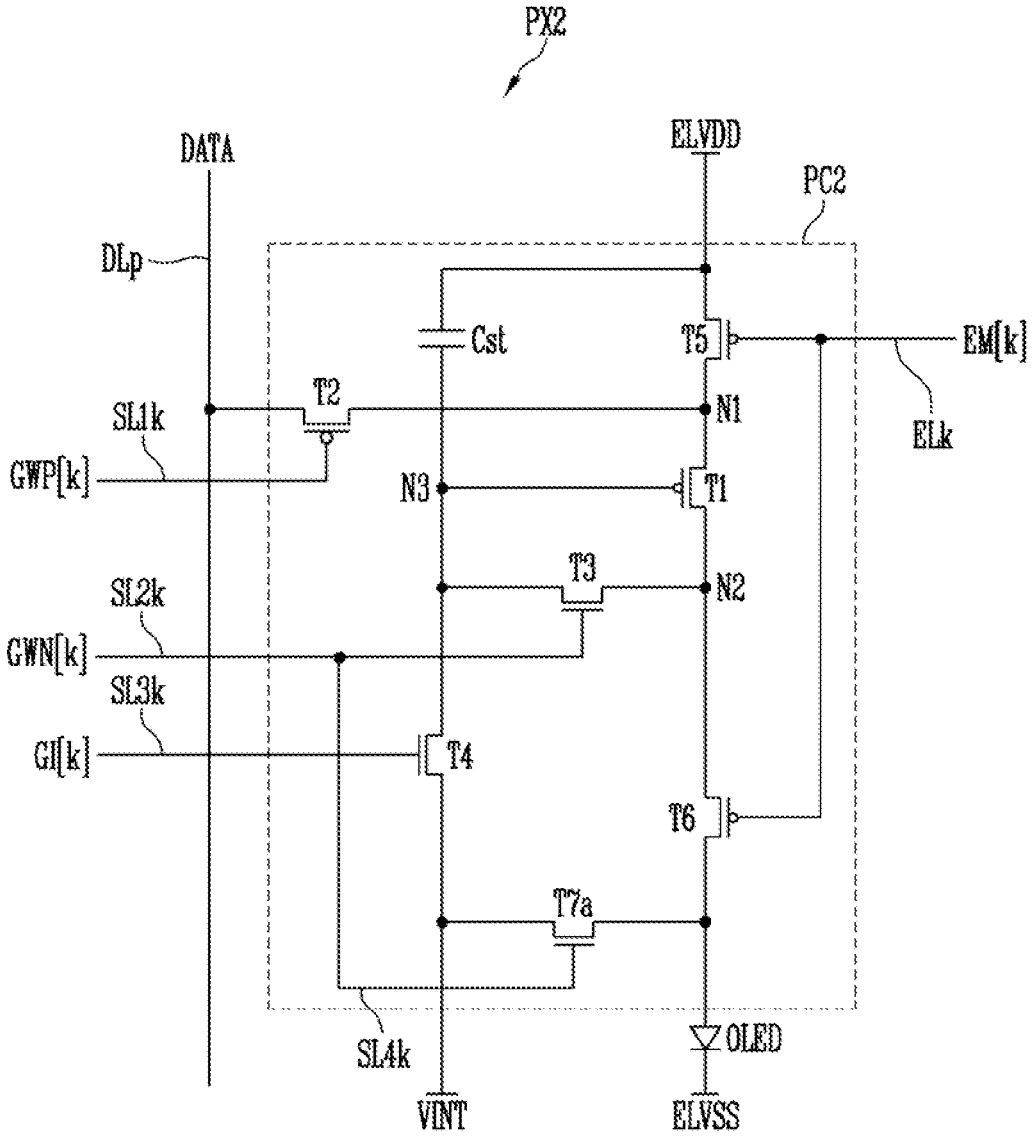
FIG. 8 is a circuit diagram illustrating an example of a pixel included in the display device of FIG. 1.
Figure 9:
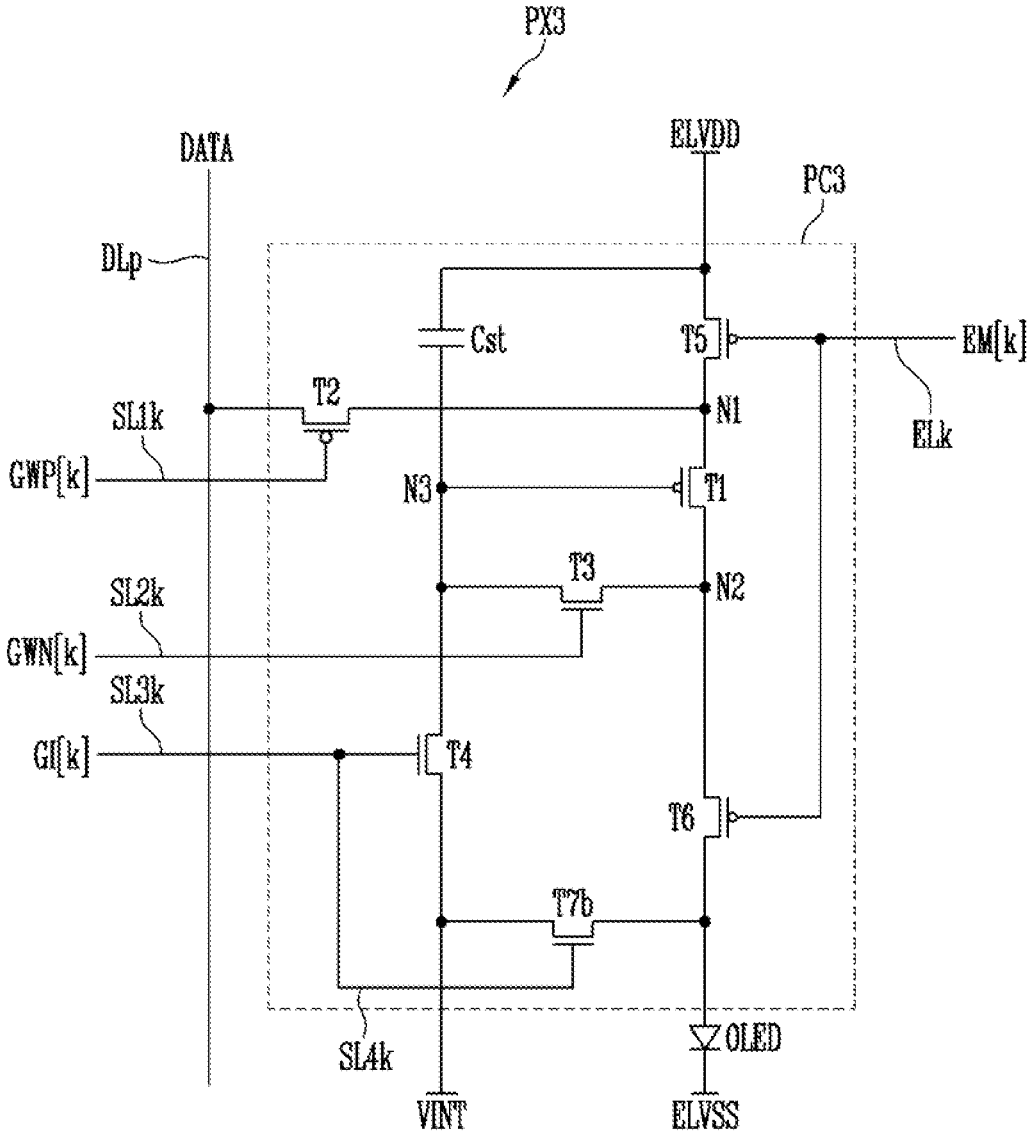
FIG. 9 is a circuit diagram illustrating an example of a pixel included in the display device of FIG. 1.

FIG. 8 is a circuit diagram illustrating an example of a pixel included in the display device of FIG. 1, and FIG. 9 is a circuit diagram illustrating an example of a pixel included in the display device of FIG. 1.

Since the pixels PX2 and PX3 of FIGS. 8 and 9 have the same configuration and operation as the pixel PX1 of FIG. 2, except for the configuration of a seventh transistor T7 included in pixel circuits PC2 and PC3, the same reference numerals are used for the same or corresponding components, and repeated descriptions thereof are omitted.

Referring to FIGS. 2, 8, and 9, each of the pixels PX2 and PX3 may include an organic light-emitting diode OLED and a pixel circuit PC2 or PC3 coupled to the organic light-emitting diode OLED.

The pixel circuit PC2 or PC3 controls the amount of current that flows from the first power source ELVDD to the second power source ELVSS via the organic light-emitting diode OLED in response to a data voltage DATA.

As illustrated in FIG. 8, the pixel circuit PC2 may include first to seventh transistors T1 to T7*a* and a storage capacitor Cst.

The seventh transistor T7*a* may be coupled between the third power source VINT and the anode electrode of the organic light-emitting diode OLED. The seventh transistor T7*a* may include a gate electrode for receiving a bypass scan signal GB[k].

In an embodiment, the seventh transistor T7*a* may be an N-type oxide semiconductor thin film transistor. A gate electrode of the seventh transistor T7*a* may receive a compensation scan signal GWN[k]. For example, a bypass scan signal (e.g., GB[k] of FIG. 2) (bypass scan pulse) for controlling the seventh transistor T7*a* may be identical to a compensation scan signal GWN[k] (compensation scan pulse). For example, a bypass scan line SL4*k* may branch from a compensation scan line SL2*k*.

As illustrated in FIG. 9, the pixel circuit PC3 may include first to seventh transistors T1 to T7*b* and a storage capacitor Cst.

The seventh transistor T7*b* may be coupled between the third power source VINT and the anode electrode of the organic light-emitting diode OLED. The seventh transistor T7*b* may include a gate electrode for receiving a bypass scan signal GB[k].

In an embodiment, the seventh transistor T7*b* may be an N-type oxide semiconductor thin film transistor. A gate electrode of the seventh transistor T7*b* may receive an initialization scan signal GI[k]. For example, a bypass scan signal (e.g., GB[k] of FIG. 2) (bypass scan pulse) for controlling the seventh transistor T7*b* may be identical to the initialization scan signal GI[k] (initialization scan pulse). For example, a bypass scan line SL4*k* may branch from an initialization scan line SL3*k*.

Since the seventh transistor T7*a* or T7*b* is embodied as an N-type oxide semiconductor thin film transistor, stages which generate a bypass scan signal for controlling the seventh transistor T7*a* or T7*b* may be removed, and thus leakage current of the seventh transistor T7*a* or T7*b* may be reduced.

Although the embodiments of the present disclosure have been described, those skilled in the art will appreciate that the present disclosure may be modified and changed in various forms without departing from the spirit and scope of the present disclosure as claimed in the accompanying claims.

The invention claimed is:

1. A display device, comprising:

a display panel including a plurality of pixels each coupled to a write scan line, a compensation scan line, an initialization scan line, a bypass scan line, and a data line; and a scan driver configured to supply an "i" number of write scan pulses, compensation scan pulses, initialization scan pulses, and bypass scan pulses to the write scan line, the compensation scan line, the initialization scan line, and the bypass scan line, respectively, during a first period corresponding to one frame period, and to supply a "j" number of write scan pulses to the write scan line during each of frame periods of a second period including a plurality of consecutive frame periods, wherein i is a natural number and j is a natural number having a value other than a value of i.

2. The display device according to claim 1, wherein the scan driver is further configured to supply less of the i number of the write scan pulses during the first period than the j number of the write scan pulses supplied during each of the frame periods of the second period.

3. The display device according to claim 1, wherein the scan driver is further configured to supply each of the write scan pulses, the compensation scan pulses, the initialization scan pulses, and the bypass scan pulses corresponding to the first period to have a first width less than a second width of each of the supplied write scan pulses corresponding to the second period.

4. The display device according to claim 1, wherein a value of i is 1 and a value of j is 3.

5. The display device according to claim 1, wherein the second period includes 59 frame periods.

6. The display device according to claim 1, further comprising:

a data driver configured to supply a data signal corresponding to a grayscale of an image to the data line in the first period.

7. The display device according to claim 6, wherein the data driver is configured to supply a preset reference voltage to the data line during the second period.

8. The display device according to claim 1, wherein the scan driver is further configured to supply one of the write scan pulses and one of the compensation scan pulses during the first period after supplying one of the initialization scan pulses.

9. The display device according to claim 8, wherein the scan driver is further configured to supply simultaneously the write scan pulses and the compensation scan pulses.

10. The display device according to claim 4, wherein the scan driver is further configured to alternately supply the i number of the initialization scan pulses and the i number of the write scan pulses.

11. The display device according to claim 1, further comprising:

an emission driver configured to supply an emission control signal to an emission control line coupled to each of the pixels, and to define an emission period and a non-emission period of each of the frame periods.

12. The display device according to claim 11, wherein:

the scan driver is configured to supply the write scan pulses, the compensation scan pulses, the initialization scan pulses, and the bypass scan pulses during the non-emission period of the first period, in which the emission control signal is not supplied; and the scan driver is further configured to supply the write scan pulses during the non-emission period of the second period.

13. The display device according to claim 12, wherein the emission driver is further configured to supply the emission control signal during, the first period having a first width that is greater than a second width of the emission control signal supplied during each of the frame periods of the second period.

14. The display device according to claim 1, wherein each of the pixels comprises:

an organic light-emitting diode a first transistor coupled between a first node, electrically coupled to a first power source, and a second node, electrically coupled to an anode electrode of the organic light-emitting diode, and configured to control a driving current;

a second transistor coupled between the data line and the first node and turned on in response to the write scan pulses;

a third transistor coupled between the second node and a third node coupled to a gate electrode of the first transistor and turned on in response to the compensation scan pulses;

a fourth transistor coupled between the third node and an initialization power source and turned on in response to the initialization scan pulses;

a fifth transistor coupled between the first power source and the first lode and turned on in response to an emission control signal;

a sixth transistor coupled between the second node and the anode electrode of the organic light-emitting diode and turned on in response to the emission control signal;

a seventh transistor coupled between the initialization power source and the anode electrode of the organic light-emitting diode and configured to receive the bypass scan pulses; and a storage capacitor coupled between the first power source and the third node.

15. The display device according to claim 14, wherein:

the first, second, fifth, and sixth transistors are P-type Low Temperature Polycrystalline silicon (LTPS) thin film transistors, and the third, fourth, and seventh transistors are N-type oxide semiconductor thin film transistors.

16. The display device according to claim 15, wherein the bypass scan pulses are identical to the compensation scan pulses.

17. The display device according to claim 15, wherein the bypass scan pulses are identical to the initialization scan pulses.

18. The display device according to claim 14, wherein:

the first, second, fifth, sixth, and seventh transistors comprise P-type Low Temperature Polycrystalline Silicon (LTPS) thin film transistors, and the third and fourth transistors are N-type oxide semiconductor thin film transistors.

19. The display device according to claim 18, wherein:

a gate-on voltage of the emission control signal, the write scan pulses, and the bypass scan pulses are set at a logic low level, and the compensation scan pulses and the initialization scan pulses are set at a logic high level.

20. The display device according to claim 18, wherein the bypass scan pulses are identical to the write scan pulses.

* * * * *